US009435174B2

(12) United States Patent
Klompsma et al.

(10) Patent No.: US 9,435,174 B2
(45) Date of Patent: Sep. 6, 2016

(54) SYSTEM AND METHOD FOR INJECTING A TREATMENT FLUID INTO A WELLBORE AND A TREATMENT FLUID INJECTION VALVE

(75) Inventors: Derk Lucas Klompsma, Sappemeer (NL); Lubbertus Lugtmeier, Assen (NL)

(73) Assignee: Shell Oil Company, Houston, TX (US)

( * ) Notice: Subject to any disclaimer, the term of this patent is extended or adjusted under 35 U.S.C. 154(b) by 129 days.

(21) Appl. No.: 14/127,306

(22) PCT Filed: Jun. 29, 2012

(86) PCT No.: PCT/EP2012/062676

§ 371 (c)(1),
(2), (4) Date: Dec. 18, 2013

(87) PCT Pub. No.: WO2013/004609

PCT Pub. Date: Jan. 10, 2013

(65) Prior Publication Data

US 2014/0182857 A1 Jul. 3, 2014

(30) Foreign Application Priority Data

Jul. 6, 2011 (EP) ..... 11172821

(51) Int. Cl.
*E21B 34/10* (2006.01)
*E21B 34/14* (2006.01)
(Continued)

(52) U.S. Cl.
CPC ..... *E21B 34/10* (2013.01); *E21B 34/14* (2013.01); *E21B 43/16* (2013.01); *E21B 43/255* (2013.01); *E21B 2034/007* (2013.01)

(58) Field of Classification Search
CPC .. E21B 34/00; E21B 34/10; E21B 2034/007; E21B 43/25; E21B 34/06; E21B 34/14; E21B 21/10; Y10T 137/7925
See application file for complete search history.

(56) References Cited

U.S. PATENT DOCUMENTS 2,144,144 A 1/1939 Crickmer
2,244,684 A 6/1941 Foran
(Continued)

FOREIGN PATENT DOCUMENTS

CA 2545828 11/2007
EP 608081 7/1994
(Continued)

OTHER PUBLICATIONS

PCT International Search Report, Application No. PCT/EP2012/062676 dated Aug. 29, 2012.
(Continued)

*Primary Examiner* — Daniel P Stephenson

(57) ABSTRACT

The invention provides a valve and method for injecting a treatment fluid into a production zone of a hydrocarbon production well. The valve comprises a tubular housing comprising an axial fluid passage, a fluid inlet in fluid communication therewith, and a lateral fluid outlet; a sleeve having a sleeve fluid passage and at least one lateral fluid opening, the sleeve being fixedly arranged within the housing and aligned with the housing fluid passage, wherein the fluid opening is aligned with the fluid outlet; and a piston moveably disposed within the sleeve fluid passage between closed and open positions, wherein the piston when closed blocks treatment fluid flow from the housing fluid passage toward the sleeve fluid passage, and wherein the piston when open permits treatment fluid flow from the fluid inlet through the housing fluid passage, the sleeve fluid passage, and the fluid opening toward the fluid outlet.

15 Claims, 4 Drawing Sheets

Figure 1:
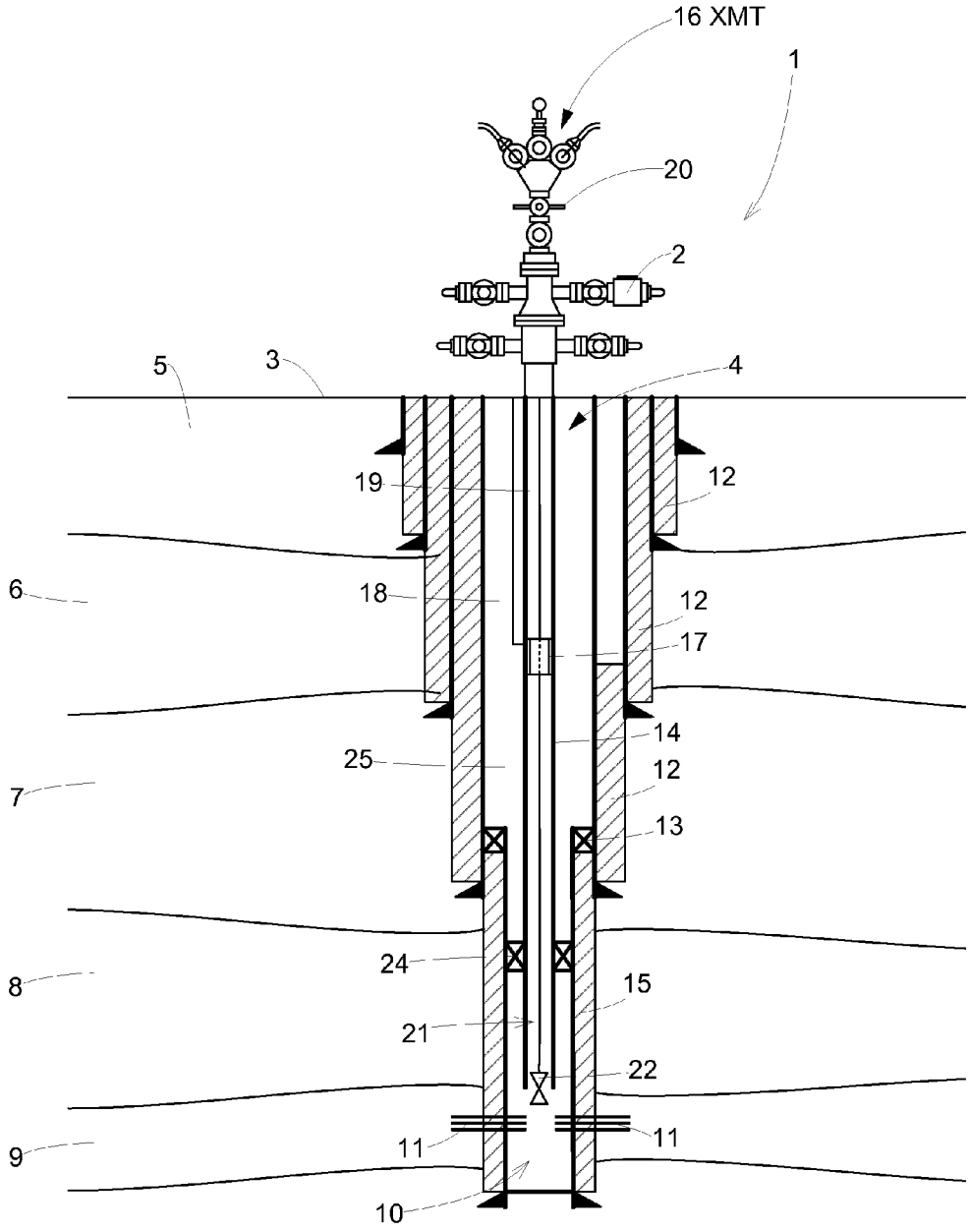

(51) Int. Cl.

| | |
|---|---|
| ***E21B 43/16*** | (2006.01) |
| ***E21B 43/25*** | (2006.01) |
| *E21B 34/00* | (2006.01) |

(56) References Cited

U.S. PATENT DOCUMENTS

| | | | | |
|---|---|---|---|---|
| 2,662,554 | A | 12/1953 | Singer | |
| 3,130,789 | A * | 4/1964 | Alexander | E21B 21/10 166/317 |
| 3,411,584 | A | 11/1968 | Sizer et al. | |
| 3,417,827 | A | 12/1968 | Smith et al. | |
| 3,494,421 | A | 2/1970 | Dollison | |
| 3,739,846 | A | 6/1973 | Beson | |
| 3,845,784 | A * | 11/1974 | Sullivan | E21B 21/10 137/515 |
| 3,878,312 | A | 4/1975 | Bergh et al. | |
| 4,042,033 | A | 8/1977 | Holland et al. | |
| 4,072,166 | A * | 2/1978 | Tiraspolsky | E21B 21/103 137/496 |
| 4,260,020 | A * | 4/1981 | Nelson | E21B 25/00 166/305.1 |
| 4,399,871 | A * | 8/1983 | Adkins | E21B 34/06 137/539.5 |
| 4,487,221 | A * | 12/1984 | Zwart | E21B 34/06 137/508 |
| 4,784,225 | A | 11/1988 | Petersen | |
| 5,027,903 | A | 7/1991 | Gipson | |
| 5,048,611 | A | 9/1991 | Cochran | |
| 5,125,457 | A | 6/1992 | Meaders | |
| 5,209,946 | A | 5/1993 | Lowther et al. | |
| 5,915,475 | A | 6/1999 | Wells et al. | |
| 6,354,465 | B2 | 3/2002 | Bell et al. | |
| 6,382,321 | B1 | 5/2002 | Bates et al. | |
| 6,427,773 | B1 * | 8/2002 | Albers | E21B 34/06 166/185 |
| 6,494,265 | B2 * | 12/2002 | Wilson | E21B 34/06 137/315.07 |
| 7,559,296 | B2 * | 7/2009 | Perotto | F01P 3/08 123/41.35 |
| 8,631,875 | B2 | 1/2014 | Nguyen et al. | |
| 2002/0157837 | A1 * | 10/2002 | Bode | E21B 23/006 166/373 |
| 2003/0056958 | A1 | 3/2003 | Allan | |
| 2003/0106588 | A1 * | 6/2003 | Zahe | F16K 17/10 137/491 |
| 2004/0035584 | A1 | 2/2004 | Gleim et al. | |
| 2004/0118567 | A1 | 6/2004 | Skeels | |
| 2005/0173125 | A1 * | 8/2005 | Naquin | E21B 21/10 166/373 |
| 2005/0252997 | A1 * | 11/2005 | Gluck | F01M 1/16 239/541 |
| 2006/0113082 | A1 | 6/2006 | Moffett et al. | |
| 2007/0108380 | A1 | 5/2007 | Poe et al. | |
| 2008/0271893 | A1 | 11/2008 | Hill et al. | |
| 2009/0200013 | A1 | 8/2009 | Craster et al. | |
| 2009/0255684 | A1 | 10/2009 | Bolding | |
| 2010/0051289 | A1 * | 3/2010 | Constantine | E21B 34/10 166/373 |
| 2010/0096127 | A1 | 4/2010 | Jordy | |
| 2010/0126725 | A1 * | 5/2010 | Ravensbergen | E21B 17/20 166/297 |
| 2011/0048724 | A1 * | 3/2011 | Pringle | E21B 43/25 166/320 |
| 2013/0133896 | A1 * | 5/2013 | Tveiten | E21B 43/123 166/363 |
| 2013/0153239 | A1 | 6/2013 | McIntosh et al. | |
| 2014/0182857 | A1 * | 7/2014 | Klompsma | E21B 34/10 166/310 |

FOREIGN PATENT DOCUMENTS

| | | | |
|---|---|---|---|
| EP | 0638372 | A1 | 2/1995 |
| EP | 2128378 | A1 | 12/2009 |
| GB | 2172321 | | 9/1986 |
| GB | 2192921 | | 1/1988 |
| GB | 2479432 | | 10/2011 |
| WO | 8602412 | | 4/1986 |
| WO | 2005045183 | A1 | 5/2005 |
| WO | 2006069247 | | 6/2006 |
| WO | 2006133351 | | 12/2006 |
| WO | 2008002473 | | 1/2008 |
| WO | 2010096349 | | 8/2010 |
| WO | 2013004609 | | 1/2013 |

OTHER PUBLICATIONS

Ali, A.J., et al.; "Investigation of New Tool to Unload Liquids From Stripper-Gas Wells"; SPE Paper 85136; SPE Annual Technical Conference and Exhibition held in Denver Colorado; Oct. 5-8, 2003.

Putra, S.A., et al; "Design of Tubing Collar Inserts for Producing Gas Wells Below Their Critical Velocity"; SPE Paper 71554; 2001 SPE Annual Technical Conference and Exhibition held in New Orleans, Louisiana; Sep. 30-Oct. 3, 2001.

Takamasa, T., et al; "Experimental Study of Gas-Liquid Two Phase-Flow Affected by Wall Surface Wettability"; International Journal of Heat and Fluid Flow 29; pp. 1593-1602; Journal Homepage: www.elsevier.com/locate/ijff; 2008.

Bolt, David: Advancements in Hydraulic Dewatering Technology, 7th European Gas Well Deliquification Conference Hydraulic Dewatering Introduction and History, Sep. 24, 2012, XP55144810, Groningen Retrieved from the Internet: URL:http://alrdc.com/workshops/2013_2013EuropeanGasWel1/Private/19_EGWDC2013_New hydraulic piston pumps_Cormorant.pdf [retrieved on Oct. 7, 2014].

Furrow, B., et al.: Gas Well Deliquification, Workshop Selection & Validation of Hydraulic Dewatering Pumps in the Natural Gas Dewatering Pumps in the Natural Gas Industry: An Update Brendan Furrow, Business Development Manager, Apr. 25, 2012, XP55144841, Retrieved from the Internet: URL:http://www.cormorant.us.eom/PDF/2012.Gas.Well.Conference.pdf [retrieved on Oct. 7, 2014].

Hydraulic Dewatering, Technology, Performance, and Applications 7th European Gas Well Deliquification Conference, Sep. 24, 2012, XP55144958, Retrieved from the Internet:URL:http://www.alrdc.com/workshops/2012_2O12EuropeanGasWell/Private/06 EGWDC 2.012 Cormorant.pdf [retrieved on Oct. 7, 2014].

* cited by examiner

SYSTEM AND METHOD FOR INJECTING A TREATMENT FLUID INTO A WELLBORE AND A TREATMENT FLUID INJECTION VALVE

PRIORITY CLAIM

The present application which is a 371 application of PCT/EP2012/062676, filed Jun. 29, 2012, claims priority from European Application EP 11172821.8, filed Jul. 6, 2011.

The invention relates to a system, a method and a treatment fluid injection valve for injecting a treatment fluid into a wellbore. The wellbore is for instance a hydrocarbon production wellbore.

At a first stage of hydrocarbon production, also referred to as primary recovery, the reservoir pressure is considerably higher than the bottomhole pressure inside the wellbore. This high natural pressure differential drives hydrocarbons toward the wellbore and up to surface. To reduce the bottomhole pressure or increase the pressure differential to increase hydrocarbon production, an artificial lift system may be used. The primary recovery stage reaches its limit when the reservoir pressure has decreased to a level where at the production rates are no longer economical. During primary recovery, only a small percentage of the initial hydrocarbons in place are produced. For example around 10 to 20% for oil or gas reservoirs.

A second stage of hydrocarbon production is referred to as secondary recovery, during which an external fluid such as water or gas is injected into the reservoir through one or more injection wells which are in fluid communication with the production well. Thus, the reservoir pressure can be maintained at a higher level for a longer period and the hydrocarbons can be displaced towards the wellbore. The secondary recovery stage reaches its limit when the injected fluid is produced in considerable amounts from the production wells and the production is no longer economical. The successive use of primary recovery and secondary recovery in a gas reservoir may produce for instance about 30 to 40% of the oil or gas in place.

Enhanced Oil Recovery (EOR) or Enhanced Gas Recovery refers to techniques for increasing the amount of hydrocarbons which can be extracted from the reservoir. Enhanced Oil Recovery or Enhanced Gas Recovery is sometimes referred to as tertiary recovery as it is typically carried out after secondary recovery, but it can be initiated at any time during the production life of the hydrocarbon reservoir. Enhanced Oil Recovery or Enhanced Gas Recovery may be achieved by injecting a treatment fluid into the hydrocarbon production wellbore.

As many hydrocarbon production wellbores are nowadays near the end of their secondary recovery production life or have already passed the secondary recovery stage, Enhanced Oil Recovery or Enhanced Gas Recovery is becoming increasingly important to maintain the production capacity and extend the production life of the well. Consequently, it is more often desirable to inject a treatment fluid into the wellbore, for example a natural gas production well.

WO 2005/045183 describes a method and system for injecting a treatment fluid into a well. The well may comprise a surface controlled subsurface safety valve (SC-SSV) which is mounted in a production tubing of the wellbore. The safety valve is typically controlled by varying fluid pressure in a valve control conduit which extends from a wellhead to the SC-SSV through an annular space between the production tubing and a wellbore casing. A treatment fluid injection conduit is connected to the valve control conduit and is suspended downwardly within the production tubing from the safety valve to a production zone of the well. The treatment fluid injection conduit may be a steel conduit having an outer diameter which is less than a centimeter and a length of, for example, 1-3 km so as to reach the production zone.

In practise, the treatment fluid injection conduit has a treatment fluid injection valve at its lower end. The treatment fluid injection valve is generally a ball and seat valve. As the treatment fluid injection valve is situated at a considerable depth below the surface, it can be subjected to a high working pressure, for example 100-300 bar. At such a high working pressure, the treatment fluid injection valve has to be displaceable between a closed position and an open position so as to accurately meter the injection of the treatment fluid into the production zone. In addition, the treatment fluid usually contains chemicals, such as a foam generating agent, which leads to fouling and corrosion of the treatment fluid injection valve. This increases the risk of failures, such as blockage, and thus negatively affects the reliability of the treatment fluid injection valve.

US-2010/0096127 discloses a constant flow valve comprising a fixed sleeve having an inlet, a fixed port formed through a side of the fixed sleeve, a floating sleeve coaxial and slidable with respect to the fixed sleeve, a floating port formed through a side of the floating sleeve and selectively registerable with the fixed port, a restriction orifice on an end of the floating sleeve in fluid communication with the floating port, and a compressible spring in contact with the restriction orifice on a side of the restriction orifice opposite the fixed sleeve. When injection fluid is directed to the inlet, the fluid flows to the fixed sleeve, through the registered fixed and floating ports, and through the restriction orifice to generate a pressure differential across the restriction orifice that creates a force to slide the floating sleeve away from the fixed sleeve. As a result the floating port and fixed port misalign which in turn reduces the flow area through the flow control device. The reduced flow area reduces flow through the ports that in turn decreases the pressure differential across the restriction orifice. When the pressure drop across the restriction orifice and the spring force are substantially the same the floating orifice will stabilize and cease to move, thereby maintaining a constant flow rate of fluid.

The constant flow valve of US-2010/0096127 is designed for a predetermined flow rate of fluid, for instance by selecting a certain spring force. It is impossible to adjust the flow rate to a lower rate, only to stop the flow. Also, the sliding sleeve, the annulus thereof and the aligning openings are prone to fouling and blocking. The latter increases risk of failures and negatively affects the reliability of the valve.

It is an object of the present invention to provide an improved system for injecting a treatment fluid into a wellbore.

The invention thereto provides a treatment fluid injection valve for injecting a treatment fluid into a wellbore, the treatment fluid injection valve comprising:

- a tubular housing comprising a housing axial fluid passage, a fluid inlet being in fluid communication with the housing axial fluid passage, and a fluid outlet;
- a sleeve member having a sleeve axial fluid passage and at least one lateral fluid opening, the sleeve member being fixedly arranged within the tubular housing, wherein the sleeve axial fluid passage is aligned with the housing axial fluid passage, and wherein the at least one lateral fluid opening is aligned with the fluid outlet; and a piston member being moveably disposed within the sleeve axial fluid passage between a closed position and an open position, wherein the piston member in the closed position blocks treatment fluid flow from the housing axial fluid passage toward the sleeve axial fluid passage, and wherein the piston member in the open position permits treatment fluid flow from the fluid inlet through the housing axial fluid passage, the sleeve axial fluid passage, and the at least one lateral fluid opening in the sleeve member toward the lateral fluid outlet of the tubular housing.

With the treatment fluid injection valve according to the invention, the closed position and the (fully) open position are defined by the movement of the piston member within the axial fluid passage of the sleeve member. The sleeve member is arranged stationary within the tubular housing. The axial fluid passage of the sleeve member forms a piston chamber for the piston member. In the closed position, the piston member blocks the flow path from the axial fluid passage in the tubular housing toward the axial fluid passage of the sleeve member so that the treatment fluid injection valve is closed. When the piston member is in the closed position, a leak rate may be zero, or at least to relatively low. The leak rate may remain zero to very low even when the treatment fluid injection valve is operated at high working pressures, for example exceeding 100 bar. Due to the construction of the injection valve according to the invention fouling and corrosion is reduced. Consequently the valve can withstand the influence of chemical treatment fluid, has an increased lifespan, and maintenance can be limited. Consequently, the treatment fluid injection valve of the invention is reliable due to reduced risks of failures. Typically, the valve can be designed to operate continuously with a chemical treatment fluid for an extended period of, for example, two years or more without failure.

In an embodiment, the axial fluid passage of the sleeve member comprises an inner circumferential surface, and wherein the piston member comprises an axial end surface and an outer circumferential surface, the outer circumferential surface of the piston member being provided with a sealing member which radially protrudes from the outer circumferential surface and engages with the inner circumferential surface of the sleeve member in a sealing manner.

The sealing member may be constructed in various ways. For example, the sealing member comprises one or more rings. The rings may include two or three rings, which are arranged at a mutual axial distance from each other. One or more of the rings can be made of a relatively hard material, such as metal or steel. An optional additional ring may provide a soft seal, for example a ring made of a resilient material, such as a rubber O-ring. The sealing member provides a fluid-tight seal between the piston member and the sleeve member. Thus, a relatively low leak rate under high working pressures can be achieved. The metal rings act as a tight labyrinth seal, or a metal-to-metal seal. The metal rings prevent high velocities at the soft seal member, and thus protect the soft seal.

In an embodiment, in the closed position the axial end surface of the piston member abuts against a seat which is made of a resilient material. The seat is situated, for example, adjacent to an axial end of the sleeve member.

When the piston member is in the closed position, the end of the piston engages the seat made of the resilient material. The resilient material may comprise, for example rubber. The engagement between the end surface and the resilient seat guarantees that the treatment fluid injection valve is closed off without any leaks. The sealing member provided radially around the piston member reduces wear of the seat. When the valve is in the open position, there is no, or hardly any, pressure difference across the resilient seal. The dynamic sealing (the piston, and optionally the sealing member) and static sealing (the resilient seat) are separated from each other. The static seal ensures proper sealing in static, closed position, limiting or obviating fluid leakage. The tougher sealing member provides sealing in a dynamic condition. Thus, the valve of the invention combines low to absent fluid leakage with relatively long lifespan of the resilient seal.

In an embodiment, the at least one lateral fluid opening in the sleeve member defines an adjustable flow area, wherein the adjustable flow area are can be adjusted by controlling the position of the piston member between the closed position and the open position. It is also possible for the piston member to be controlled to at least one partially open position between the closed position and the (fully) open position, and wherein, with the piston member in the open position, the at least one lateral fluid opening in the sleeve member defines a first flow area, and wherein, with the piston member in its at least one partially open position, the at least one lateral fluid opening in the sleeve member defines a second flow area which is smaller than the first flow area.

With the piston member in the open position, the lateral fluid opening in the sleeve member defines a flow area corresponding to a predetermined maximum volume flow. In a partially open position, the lateral fluid opening in the sleeve member defines a respective flow area which is smaller than the flow area corresponding to the predetermined maximum volume flow. The piston member can be displaced from the closed position to the partially open position ("throttling position") by controlling the pressure of the treatment fluid in the sleeve axial fluid passage. Thus, the flow area defined by the lateral fluid opening in the sleeve member can be adjusted by displacing the piston member, and thus the treatment fluid injection valve can be operated to deliver metered amounts of treatment fluid from the treatment fluid injection conduit to the production zone of the hydrocarbon production well. In other words, it is possible to accurately meter the amount of injected treatment fluid. For example, the treatment fluid injection valve may be configured to inject 1 to 5 liters per hour.

In addition, when the treatment fluid is a chemical, for example a foaming agent, it may form a deposit on the edges of the lateral fluid opening, which causes a risk of blocking. According to this embodiment, the flow area defined by the lateral fluid opening in the sleeve member can be increased by the operation of the piston member so as to wash away any residuals which may have set onto the lateral fluid opening during use. Thus, the lateral fluid opening can be periodically cleaned by temporarily increasing the volume flow through the lateral fluid opening. This results in a treatment fluid injection valve having excellent reliability.

The at least one lateral fluid opening of the sleeve member may comprise a single lateral fluid opening or a plurality of lateral fluid openings.

In a particular embodiment, the sleeve member comprises at least a first lateral fluid opening and at least a second lateral fluid opening which is arranged at an axial distance from the first lateral opening, wherein the piston member can be moved incrementally from the closed position to a first partially open position and from the first partially open position to a second partially open position, wherein the piston member in its first partially open position permits treatment fluid flow through the first lateral fluid opening in the sleeve member and blocks treatment fluid flow from the axial fluid passage of the sleeve member toward the second lateral fluid opening of the sleeve member, and wherein the piston member in its second partially open position permits treatment fluid flow through the first and second lateral fluid openings in the sleeve member.

When the piston member is displaced from the closed position over an incremental distance to the first partially open position, treatment fluid is allowed to flow through the flow path from the fluid inlet through the axial fluid passage in the tubular housing, the axial fluid passage of the sleeve member, and the first lateral fluid opening in the sleeve member toward the lateral fluid outlet in the tubular housing. At the same time, the piston member, in particular its sealing member, prevents treatment fluid from flowing from the fluid inlet through the axial fluid passage in the tubular housing, the axial fluid passage in the sleeve member and into the second lateral fluid opening. Thus, the treatment fluid injection valve is operated to inject a metered volume of treatment fluid corresponding to the first lateral fluid opening.

From the first partially open position, the piston member may be displaced over a further incremental distance to the second partially open position, wherein treatment fluid is allowed to flow through the first and second lateral fluid opening in the sleeve member toward the lateral fluid outlet in the tubular housing. As a result, the metered amount of treatment fluid is increased. It should be noted that the sleeve member may comprise further lateral fluid openings which are arranged at an axial distance from each other and accordingly further partially open positions of the piston member. In the second partially open position, the piston member blocks treatment fluid flow from the axial fluid passage in the sleeve member toward the further lateral openings.

It is possible for the treatment fluid injection valve to comprise a spring member which biases the piston member to the closed position. The spring provides a bias force upon the piston member for returning the piston member toward the closed position. The bias force can be overcome by the pressure of treatment fluid flowing into the axial fluid passage in the tubular housing and acting onto the pressure-receiving axial end surface of the piston member. When the pressure is increased within the treatment fluid injection conduit, it bears upon the pressure-receiving end surface of the piston member to urge the piston member to move axially with respect to the sleeve member in the direction toward the open position, and the spring member is compressed by the piston member. For example, the spring member comprises a compression spring which is pretensioned between the piston member and a setting screw which is received into the tubular housing.

In an embodiment, the sleeve member is removably arranged within the tubular housing. Thus, the sleeve member can be easily replaced by another sleeve member being identical to the retrieved sleeve member or having a different configuration for the at least one lateral fluid opening so as to modify the volume flow characteristics of the treatment fluid injection valve.

The invention also relates to a hydrocarbon production well, comprising a casing, a production tubing which is arranged within the casing so as to define an annular space between the production tubing and the casing, and a system for injecting a treatment fluid into a production zone of a hydrocarbon production well as described above.

It is possible for the hydrocarbon production well to comprise a downhole safety valve which is mounted in the production tubing, and wherein the treatment fluid injection conduit is suspended from the safety valve into the production tubing below the safety valve such that the treatment fluid injection valve is located at a distance below the safety valve. In this case, the treatment fluid injection conduit may extend from the wellhead within the production tubing to the downhole safety valve and through the downhole safety valve. The downhole safety valve may be a surface-controlled subsurface safety valve (SCSSSV). The surface-controlled subsurface safety valve is generally installed at a depth of at least 50 m, such as about 100 m. The treatment fluid injection conduit extends below the surface-controlled subsurface safety valve, for example over a length of at least 1000 m.

It is also possible for the hydrocarbon production well to comprise a packer member which is arranged between the production tubing and the casing so as to secure in place a lower portion of the production tubing, wherein the treatment fluid injection conduit extends below the packer member such that the treatment fluid injection valve is located at a distance below the packer member. The packer member is generally installed at a lower portion of the production tubing. The portion of the production tubing below the packer member is generally referred to as the tail. The treatment fluid injection valve is situated at a depth below the tail packer member.

The invention furthermore relates to a method for injecting a treatment fluid into a wellbore, comprising injecting the treatment fluid into the production zone of the wellbore as described above and/or using a system as described above. The invention also relates to a method for producing hydrocarbons, comprising a method for injecting a treatment fluid into a production zone of a hydrocarbon production wellbore of this type.

In addition, the invention relates to a treatment fluid injection valve for injecting a treatment fluid into a production zone of a hydrocarbon production well, the treatment fluid injection valve comprising:

- a tubular housing comprising a housing axial fluid passage, a fluid inlet being connectable to a downhole end of a treatment fluid injection conduit and being in fluid communication with the housing axial fluid passage, and a fluid outlet;
- a sleeve member having a sleeve axial fluid passage, the sleeve member being arranged within the tubular housing wherein the sleeve axial fluid passage is aligned with the housing axial fluid passage, the sleeve member comprising at least one lateral fluid opening; and
- a piston member being moveably disposed within the sleeve axial fluid passage between a closed position and an open position, wherein the piston member in the closed position blocks treatment fluid flow from the housing axial fluid passage toward the sleeve axial fluid passage, and wherein the piston member in the open position permits treatment fluid flow from the fluid inlet through the housing axial fluid passage, the sleeve axial fluid passage, and the lateral fluid opening in the sleeve member toward the fluid outlet of the tubular housing.

The treatment fluid injection valve according to the invention may comprise any of the features described in the claims and the description above, either individually or in any combination of features.

The invention will now be explained, merely by way of example, with reference to the accompanying drawings.

FIG. 1 shows a cross-sectional view of an exemplary hydrocarbon production well provided with a system for injecting a treatment fluid in accordance with the present invention.

Figure 2A:
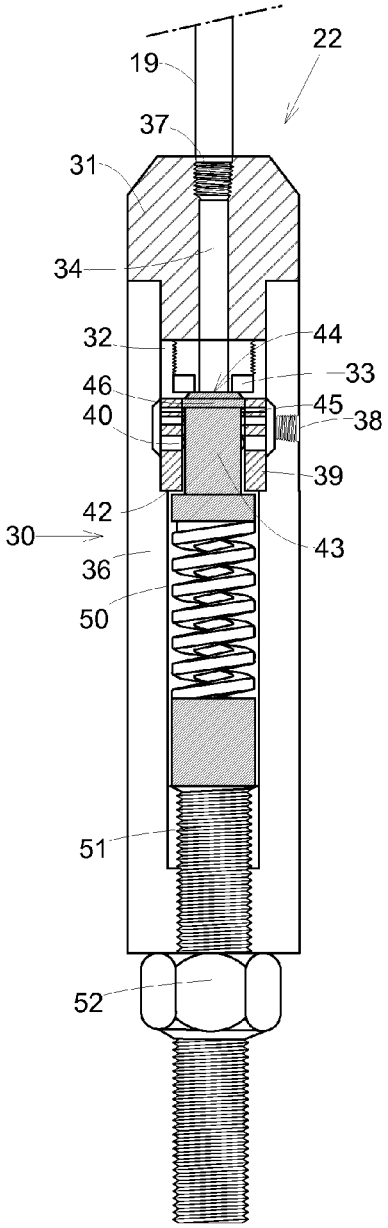

FIG. 2*a* shows a cross-sectional view of a treatment fluid injection valve of the system for injecting a treatment fluid shown in FIG. 1, wherein the treatment fluid injection valve is in a closed position.

Figure 2B:
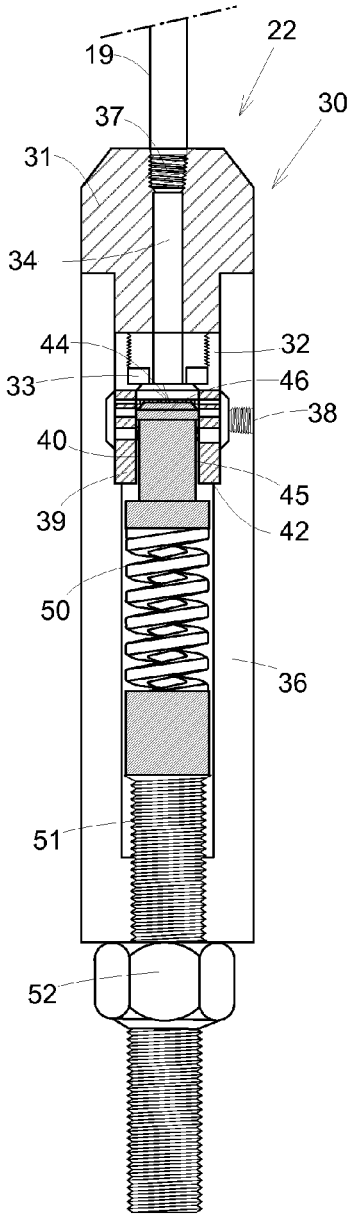

FIG. 2*b* shows a cross-sectional view of the treatment fluid injection valve shown in FIG. 2*a*, wherein the treatment fluid injection valve is in a partially open position ("throttling position").

Figure 2C:
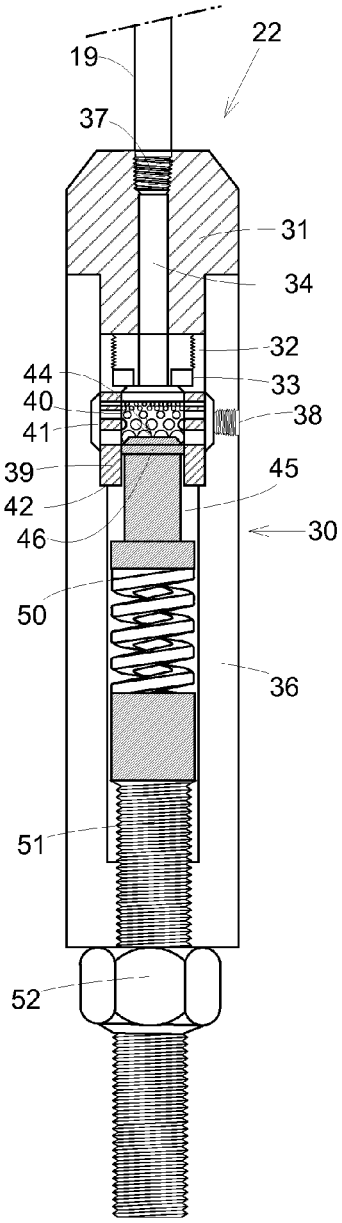

FIG. 2*c* shows a cross-sectional view of the treatment fluid injection valve shown in FIG. 2*a*, wherein the treatment fluid injection valve is in an open position.

Figure 3:
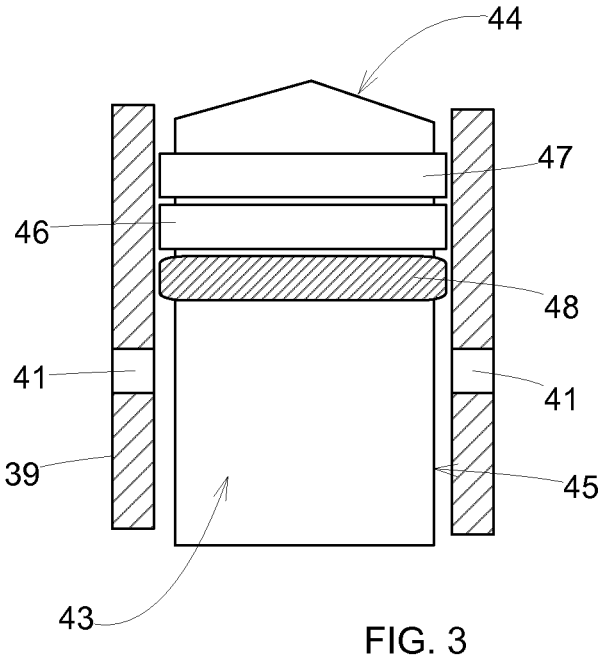

FIG. 3 shows a cross-sectional view of a sealing member for sealing the piston member with respect to the sleeve member of the treatment fluid injection valve shown in FIG. 2*a*.

FIGS. 4*a*, 4*b*, 4*c*, 4*d* show cross-sectional views of exemplary embodiments of sleeve members which can be used with the treatment fluid injection valve shown in FIG. 2*a*.

FIG. 1 schematically shows a wellbore 1 according to the invention. The wellbore 1 comprises a borehole 4 which has been drilled from the surface 3 through a number of earth formations 5, 6, 7, 8 up to a production formation 9. The production formation 9 comprises hydrocarbons, for example oil and/or gas. The wellbore 4 is lined with casings 12 and a liner 15 which is suspended from the lowermost casing 12 by means of a liner hanger 13. The liner 15 extends from the lowermost casing 12 to the production formation 9 and comprises perforations 11 for allowing fluid communication from the production formation 9 to a production zone 10 of the hydrocarbon production well 1.

A production tubing 14 is disposed within the casings 12 and the liner 15 of the wellbore 4. The production tubing 14 may be constructed in various ways. For example, the production tubing 14 comprises sections of standard production tubing which are connected together by threads. The production tubing 14 extends from a wellhead 2 of the hydrocarbon production well 1 to the production zone 10. Production fluids, such as oil and/or gas, may be conveyed to the wellhead 2 at the surface 3 through the interior of the production tubing 14. A Christmas tree 16 is installed on the wellhead 2 so as to control fluid flow in and out of the wellbore 4.

A downhole safety valve 17 is installed within the production tubing 14. In this exemplary embodiment, the downhole safety valve 17 is constructed as a surface-controlled subsurface safety valve. The safety valve 17 may be situated at a depth greater than 50 m, for example at approximately 100 m. The safety valve 17 provides emergency closure of the production tubing 14 in the event of an emergency. The safety valve 17 is designed to be fail-safe, i.e. the wellbore 4 is isolated in the event of failure or damage to the surface production control equipment. An annular space 25 is defined between the outer radial surface of the production tubing 14 and the casings 12. A hydraulic control line 18 extends from the surface 3 within the annular space 25 to the safety valve 17 so as to control the safety valve.

A packer member 24 is arranged between the production tubing 14 and the liner 15 so as to secure in place a lower portion of the production tubing 14 and to substantially isolate the annular space 25 from the interior of the production tubing 14. For example, the packer member 24 comprises a means for securing the packer member 24 against the wall of the liner 15, such as a slip arrangement, and a means for establishing a reliable hydraulic seal to isolate the annular space 25, typically by means of an expandable elastomeric element. The portion of the production tubing 14 below the packer member 24 is generally referred to as the tail.

The hydrocarbon production well 1 according to the invention comprises a system for injecting a treatment fluid into the production zone 10. The system for injecting a treatment fluid into the production zone 10 comprises a treatment fluid injection conduit 19 having an upper supply end 20 and a lower discharge end 21. In this exemplary embodiment, the upper supply end 20 is installed in the Christmas tree 16.

The treatment fluid injection conduit 19 is arranged in the interior of the production tubing 14 to the safety valve 17. The treatment fluid injection conduit 19 extends through the safety valve 17 and runs further downward through the interior of the production tubing 14 up to the lower discharge end 21 in the production zone 10. Thus, the treatment fluid injection conduit 19 extends below below the safety valve 17 and below the packer member 24. The treatment fluid injection conduit 19 may be several kilometers long.

For example, the treatment fluid injection conduit 19 comprises an upper pipe which runs from the wellhead 2 to the safety valve 17, a duct which is arranged in the safety valve 17, and a lower pipe which extends from the safety valve 17 to the production zone 10. The inner diameter of the pipes may be, for example, less than 1 cm, preferably less than 0.5 cm. The lower end of the treatment fluid injection conduit 19 comprises a treatment fluid injection valve 22.

FIGS. 2*a*, 2*b*, 2*c* illustrate an exemplary embodiment of the treatment fluid injection valve 22. The treatment fluid injection valve 22 comprises a tubular housing 30 which comprises a circumferential wall 36 and an upper end sub 31 which is secured at the upper axial end of the circumferential wall 36. A sleeve member 39 is fitted within the tubular housing 30 against a shoulder 42 of the circumferential wall 36 which extends radially inward. A seat member 32 is secured within the tubular housing 30 between the sleeve member 39 and the upper end sub 31.

A fluid inlet 37 is arranged in the upper axial end face of the tubular housing 30. The fluid inlet 37 is connected to the lower end of the treatment fluid injection conduit 19. A lateral fluid outlet 38 is arranged in the circumferential wall 36 of the tubular housing 30. The tubular housing 30 comprises an axial fluid passage 34 which extends through the upper end sub 31 and the seat member 32. The fluid inlet 37 is in fluid communication with the axial fluid passage 34. The sleeve member 39 comprises an axial fluid passage 40 which is in alignment with the axial fluid passage 34 so that the axial fluid passages 34, 40 of the tubular housing 30 and the sleeve member 39 are connected to each other.

The sleeve member 39 comprises at least one lateral fluid opening 41. In this exemplary embodiment, the sleeve member 39 comprises five rows of lateral fluid openings 41 (see FIG. 2*c*). However, the sleeve member 39 may comprise any number of rows of lateral fluid openings. The lateral fluid openings 41 of each row are distributed circumferentially over the sleeve member 39, and the rows of lateral fluid openings 41 are arranged at an axial distance from each other. The lateral fluid openings 41 of the uppermost row have a smaller diameter than the lateral fluid openings 41 of lower rows. Thus, the flow area of the lateral fluid openings 41 in the row directly below the uppermost row is greater than the flow area of the lateral fluid openings 41 in the uppermost row.

The treatment fluid injection valve 22 comprises a piston member 43 which is radially surrounded by the sleeve member 39. The piston member 43 is moveably disposed within the axial fluid passage 40 of the sleeve member 39 between a closed position shown in FIG. 2*a* and a fully open position shown in FIG. 2*c*. The axial fluid passage 40 of the sleeve member 39 constitutes a piston chamber. The piston member 43 is disposed within the surrounding sleeve member 39 with a relatively close fit.

The piston member 43 is biased to the closed position by a spring member 50. In this exemplary embodiment, the spring member 50 comprises a compression spring which provides a bias force upon the piston member 43 for returning the piston member 43 toward the closed position. The bias force can be adjusted by means of a setting screw 51 which is secured by a locking bolt 52.

The piston member 43 comprises an axial end surface 44 and an outer circumferential surface 45. The outer circumferential surface 45 of the piston member 43 is provided with a sealing member 46. As shown in FIG. 3, in this exemplary embodiment, the sealing member 46 comprises two metal piston rings 47 ("hard seal") and a resilient piston ring 48 ("soft seal"). Thus, the piston rings 46, 47 radially protrude from the outer circumferential surface 45 and engage with the inner circumferential surface of the sleeve member 39 in a sealing manner.

In the closed position as shown in FIG. 2*a*, the axial end surface 44 of the piston member 43 abuts against the seat member 32, in particular against a seat ring 33 which comprises a resilient material ("soft seal"). Thus, the piston member 43 in the closed position blocks treatment fluid flow from the axial fluid passage 34 toward the axial fluid passage 40 of the sleeve member 39. The sealing member 46 and the seat member 32 closes off the flow path from the fluid inlet 37 through the axial fluid passages 34, 40 and the lateral fluid openings 41 in the sleeve member 39 toward the lateral fluid outlet 38. The use of the sealing member 46 and the seat member 32 results in a very low leak rate, whereas the sealing member 46 also protects the seat member 32 against wear so that the treatment fluid injection valve 22 can be operated in a reliable manner for a long period.

The bias force exerted onto the piston member 43 by the spring member 50 can be overcome by the pressure of treatment fluid flowing into the axial fluid passage 34 in the tubular housing and acting onto the pressure-receiving axial end surface 44 of the piston member 43. When the pressure is increased within the treatment fluid injection conduit 19, it bears upon the pressure-receiving end surface 44 of the piston member 43 to urge the piston member 43 to move axially downward in the axial fluid passage 40 in the sleeve member 39. This unseats the piston member 43 from the seat member 32. By controlling the pressure of the treatment fluid, the piston member 43 can be moved in an incremental or continuously variable manner. Thus, the piston member 43 can be controlled to the partially open position shown in FIG. 2*b* ("throttling position").

In the partially open position shown in FIG. 2*b*, the piston member 43 has opened the lateral fluid openings 41 of the uppermost row. Thus, the piston member 43 permits treatment fluid flow from the fluid inlet 37 through the axial fluid passages 34, 40 and the lateral fluid openings 41 in the uppermost row of the sleeve member 39 toward the lateral fluid outlet 38 in the circumferential wall 36 of the tubular housing. As the piston member 43 still blocks the flow path through the lateral fluid openings 41 of the rows below the uppermost row, the flow area of the lateral fluid openings 41 of the uppermost row defines the volume flow of treatment fluid which flows out of the treatment fluid injection valve 22.

From the partially open position shown in FIG. 2*b*, the piston member 43 can be displaced over a further incremental distance so as to open the lateral fluid openings 41 of the row directly below the uppermost row of lateral fluid openings 41. Thus, the lateral fluid openings 41 in the sleeve member define an adjustable flow area which can be adjusted by controlling the position of the piston member 43 between the closed position shown in FIG. 2*a* and the fully open position shown in FIG. 2*c*.

As a result, the amount of treatment fluid to be discharged from the treatment fluid injection valve 22 can be accurately metered. In addition, when a chemical treatment fluid is used which leads to clogging of the lateral fluid openings 41 of the uppermost row, the piston member 43 can be temporarily displaced to a lower position so that the lateral fluid openings 41 of one or more lower rows are opened. Consequently, the volume flow of treatment fluid can be temporarily increased so as to wash away any caked residuals of treatment fluid and to clean the lateral fluid openings 41.

The piston member 43 can be displaced from the partially open position shown in FIG. 2*b* to the fully open position in FIG. 2*c*, wherein the lateral fluid openings 41 of each row are opened. With the piston member 43 in its the fully open position, the lateral fluid openings 41 in the sleeve member 39 define a maximum flow area. As shown in FIG. 2*c*, the lateral fluid openings 41 of the lowermost row may still be partially covered by the piston member 43 in its open position.

Figure 4A:
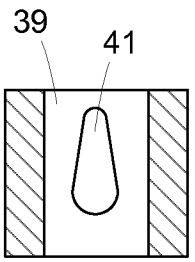
Figure 4B:
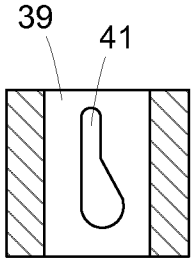
Figure 4C:
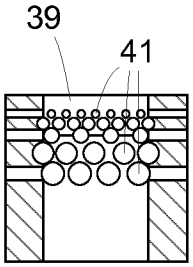
Figure 4D:
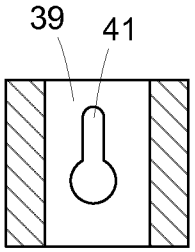

The sleeve member 39, in particular the lateral fluid opening 41 or the lateral fluid openings 41 in the sleeve member 39, can be constructed in various ways. FIGS. 4*a*, 4*b*, 4*d* show exemplary embodiments of sleeve members having a single lateral fluid opening 41, whereas FIG. 4*c* illustrates the sleeve member 39 shown in FIGS. 2*a*, 2*b*, 2*c*.

The description above describes exemplary embodiments of the present invention for the purpose of illustration and explanation. It will be apparent, however, to the skilled person that many modifications and changes to the exemplary embodiments set forth above are possible without departing from the scope of the invention. It is noted that the features described above may be combined, each individually or in any combination of features, with one or more of the features of the claims.

The invention claimed is:

1. A treatment fluid injection valve for injecting a treatment fluid into a wellbore, the treatment fluid injection valve comprising:

a tubular housing comprising a housing axial fluid passage, a fluid inlet being in fluid communication with the housing axial fluid passage, and a lateral fluid outlet;

a sleeve member having a sleeve axial fluid passage and at least one lateral fluid opening, the sleeve member being fixedly arranged within the tubular housing, wherein the sleeve axial fluid passage is aligned with the housing axial fluid passage, and wherein the at least one lateral fluid opening is aligned with the lateral fluid outlet; and a piston member being moveably disposed within the sleeve axial fluid passage between a closed position and an open position, wherein the piston member in the closed position blocks treatment fluid flow from the housing axial fluid passage toward the sleeve axial fluid passage, and wherein the piston member in the open position permits treatment fluid flow from the fluid inlet through the housing axial fluid passage, the sleeve axial fluid passage, and the at least one lateral fluid opening in the sleeve member toward the lateral fluid outlet of the tubular housing;

wherein the lateral fluid opening in the sleeve member defines an adjustable flow area, wherein the adjustable flow area is adjustable by controlling the position of the piston member relative to the lateral fluid opening to a partially open position between the closed position and the open position.

2. The valve as claimed in claim 1, wherein the sleeve axial fluid passage comprises an inner circumferential surface, and wherein the piston member comprises an axial end surface and an outer circumferential surface, the outer circumferential surface of the piston member being provided with a sealing member which radially protrudes from the outer circumferential surface and engages with the inner circumferential surface of the sleeve member in a sealing manner.

3. The valve of claim 2, wherein the sealing member comprises a metal.

4. The valve of claim 2, wherein the axial end surface of the piston member in the closed position abuts against a seat member which comprises a resilient material.

5. The valve of claim 1, wherein the piston member can be controlled to at least one partially open position between the closed position and the open position, wherein, with the piston member in the open position, the lateral fluid opening in the sleeve member defines a first flow area, and wherein, with the piston member in its at least one partially open position, the lateral fluid opening in the sleeve member defines a second flow area which is smaller than the first flow area.

6. The valve of claim 1, wherein the piston member can be adjusted between the closed position and the open position by adjusting a fluid pressure of the treatment fluid at the fluid inlet.

7. The valve of claim 1, wherein a diameter of the at least one lateral fluid opening increases in a direction away from the fluid inlet.

8. The valve of claim 1, wherein the at least one lateral fluid opening comprises a plurality of openings which increase in diameter in a direction away from the fluid inlet.

9. The valve of claim 1, wherein the at least one lateral fluid opening comprises an opening having a droplet shape which increases in diameter in a direction away from the fluid inlet.

10. The valve of claim 1, wherein the at least one lateral fluid opening comprises an opening having a keyhole shape which increases in diameter in a direction away from the fluid inlet.

11. The valve of claim 1, wherein the sleeve member comprises at least a first lateral fluid opening and at least a second lateral fluid opening which is arranged at an axial distance from the first lateral opening, and wherein the piston member is moveable incrementally from the closed position to a first partially open position and from the first partially open position to a second partially open position, wherein the piston member in its first partially open position permits treatment fluid flow through the first lateral fluid opening in the sleeve member and blocks treatment fluid flow from the sleeve axial fluid passage toward the second lateral fluid opening of the sleeve member, and wherein the piston member in its second partially open position permits treatment fluid flow through the first lateral fluid opening and the second lateral fluid opening in the sleeve member.

12. The valve of claim 1, comprising a spring member for biasing the piston member in the closed position.

13. The valve of claim 1, wherein the sleeve member is replaceable in the tubular housing.

14. A method for injecting a treatment fluid into a production zone of a hydrocarbon production well, comprising injecting the treatment fluid into the production zone of the hydrocarbon production well using a valve as claimed in claim 1.

15. A system for injecting a treatment fluid into a wellbore, the system comprising:

a treatment fluid injection conduit which is configured to extend from a wellhead of the wellbore to a downhole end in a production zone, the downhole end of the treatment fluid injection conduit being provided with a treatment fluid injection valve, the treatment fluid injection valve comprising:

a tubular housing comprising a housing axial fluid passage, a fluid inlet being in fluid communication with the housing axial fluid passage, and a lateral fluid outlet;

a sleeve member having a sleeve axial fluid passage and at least one lateral fluid opening, the sleeve member being fixedly arranged within the tubular housing, wherein the sleeve axial fluid passage is aligned with the housing axial fluid passage, and wherein the at least one lateral fluid opening is aligned with the lateral fluid outlet; and a piston member being moveably disposed within the sleeve axial fluid passage between a closed position and an open position, wherein the piston member in the closed position blocks treatment fluid flow from the housing axial fluid passage toward the sleeve axial fluid passage, and wherein the piston member in the open position permits treatment fluid flow from the fluid inlet through the housing axial fluid passage, the sleeve axial fluid passage, and the at least one lateral fluid opening in the sleeve member toward the lateral fluid outlet of the tubular housing.

* * * * *